US008636335B2

(12) United States Patent
Hotta et al.

(10) Patent No.: US 8,636,335 B2
(45) Date of Patent: Jan. 28, 2014

(54) LIQUID EJECTING HEAD AND LIQUID EJECTING APPARATUS

(75) Inventors: Akira Hotta, Matsumoto (JP); Shunsuke Watanabe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 358 days.

(21) Appl. No.: 13/075,142

(22) Filed: Mar. 29, 2011

(65) Prior Publication Data

US 2011/0242194 A1 Oct. 6, 2011

(30) Foreign Application Priority Data

Mar. 30, 2010 (JP) ..... 2010-079649

(51) Int. Cl.
*B41J 2/175* (2006.01)

(52) U.S. Cl.
USPC ..... 347/20; 347/29

(58) Field of Classification Search
USPC ..... 347/84, 85, 20, 29
See application file for complete search history.

(56) References Cited

U.S. PATENT DOCUMENTS 6,439,908 B1 * 8/2002 Silverbrook et al. ..... 439/212

FOREIGN PATENT DOCUMENTS

JP 2003-039672 A 2/2003

* cited by examiner

*Primary Examiner* — Laura Martin
(74) *Attorney, Agent, or Firm* — Kilpatrick Townsend & Stockton LLP

(57) ABSTRACT

A liquid ejecting head includes a main liquid ejecting head body, a head holder, and a sealing member, disposed between the main liquid ejecting head body and the head holder, that has a communication opening that communicates between a first liquid flow channel and a second liquid flow channel. The sealing member further has a close-contact portion provided at the circumferential edge of the communication opening; a first contact portion, provided in correspondence with the external circumferential portion of the main liquid ejecting head body, that protrudes toward the main liquid ejecting head body and makes contact with the main liquid ejecting head body; and a second contact portion that protrudes toward the head holder and makes contact with the head holder.

9 Claims, 6 Drawing Sheets

LIQUID EJECTING HEAD AND LIQUID EJECTING APPARATUS

BACKGROUND

The entire disclosure of Japanese Patent Application No. 2010-079649, filed Mar. 30, 2010, is expressly incorporated herein by reference.

1. Technical Field

The present invention relates to liquid ejecting heads and liquid ejecting apparatuses.

2. Related Art

The ink jet recording head disclosed in JP-A-2003-39672, which includes a flow channel unit in which nozzles and pressure generation chambers that eject ink supplied from a holding member such as an ink cartridge are formed, a main head body that has a head case housing piezoelectric elements affixed to the flow channel unit, and a head holder to which multiple head main bodies are anchored, can be given as an example of an ink jet recording head, which is in turn a representative example of a liquid ejecting head.

Meanwhile, in such an ink jet recording head, a sealing member having a communication opening is generally sandwiched between the main head body and the head holder, and a flow channel in the head holder and a flow channel in the main head body communicate via this communication opening.

If the sealing member is simply provided as described above, ink will infiltrate the main head body, the head holder, and so on, and thus a molding is created around the outer edge of the sealing member using an adhesive, thus stopping ink from infiltrating.

However, such a molding is problematic in that it leads to an increase in costs, and the head itself becomes difficult to break down and reuse.

It should be noted that such problems are not limited to ink jet recording heads that eject ink, but are also present in other liquid ejecting heads that eject liquids aside from ink.

SUMMARY

A liquid ejecting head according to an aspect of the invention includes: a main liquid ejecting head body, in which is formed a first liquid flow channel through which a liquid flows, that is configured so as to eject the liquid from a nozzle opening using a pressurizing unit; a head holder including a second liquid flow channel, one end of the second liquid flow channel communicating with a holding member that holds the liquid and the other end of the second liquid flow channel communicating with the first liquid flow channel; and a sealing member, disposed between the main liquid ejecting head body and the head holder, that includes a communication opening that communicates between the first liquid flow channel and the second liquid flow channel. The sealing member further has: a close-contact portion provided in the circumferential edge of the communication opening; a first contact portion, provided in correspondence with the outer circumferential portion of the main liquid ejecting head body, that protrudes toward the main liquid ejecting head body and makes contact with the main liquid ejecting head body; and a second contact portion that protrudes toward the head holder and makes contact with the head holder.

Another aspect of the invention is a liquid ejecting apparatus including the liquid ejecting head according to the aforementioned aspect.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
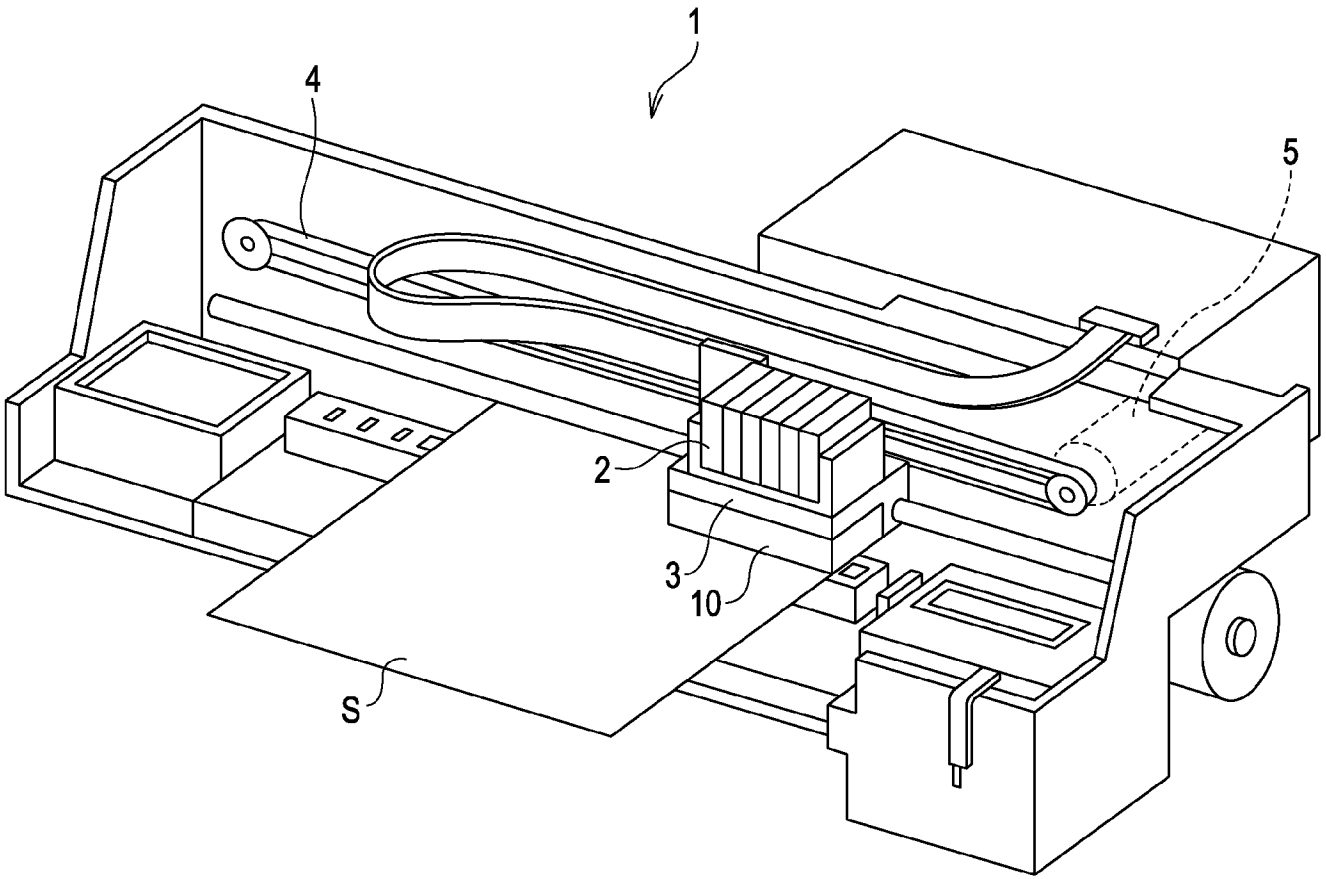
FIG. 1 is a schematic cross-sectional view of a liquid ejecting apparatus according to an embodiment of the invention.

An ink jet recording apparatus will be described based on FIG. 1. As illustrated in FIG. 1, an ink jet recording apparatus 1 serving as a liquid ejecting apparatus includes an ink jet recording head (called simply a "head" hereinafter) 10 serving as a liquid ejecting head. The head 10 is anchored to a carriage 3 in which an ink cartridge 2 is mounted. The carriage 3 has a box shape whose upper portion is open, and is attached so that a nozzle surface of the head 10 is exposed on the surface of the carriage 3 that faces recording paper S (that is, the bottom surface); the ink cartridge 2 is housed within the carriage 3. Ink from the ink cartridge 2 is supplied to the head 10.

The carriage 3 is connected to a stepping motor 5 via a timing belt 4, and moves back and forth in the paper width direction of the recording paper S (that is, in the main scanning direction). Through this, ink droplets are ejected onto the top surface of the recording paper S while moving the carriage 3, thus printing images, text, or the like on the recording paper S as a dot matrix.

Note that, in the example shown in FIG. 1, is illustrated an example in which the ink cartridge 2 is held in the carriage 3 as a liquid source, but the invention can also be applied in the case of an ink jet recording apparatus configured so that the ink cartridge 2 is held in a different location than the carriage 3 and the ink is pressure-transferred to a flow channel formation portion of the head 10 via a supply pipe.

Figure 2:
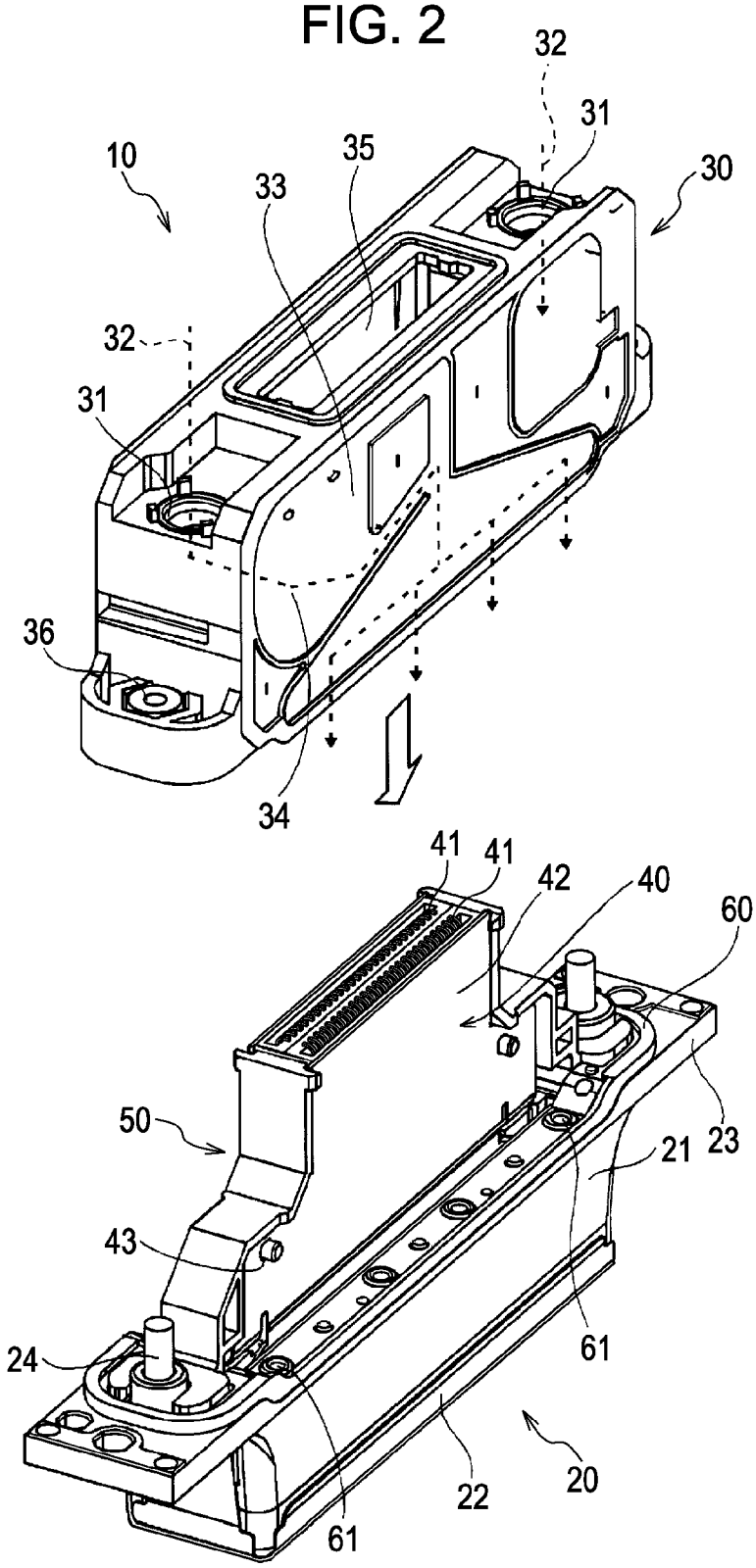
FIG. 2 is an exploded perspective view illustrating a head according to an embodiment of the invention.
Figure 3:
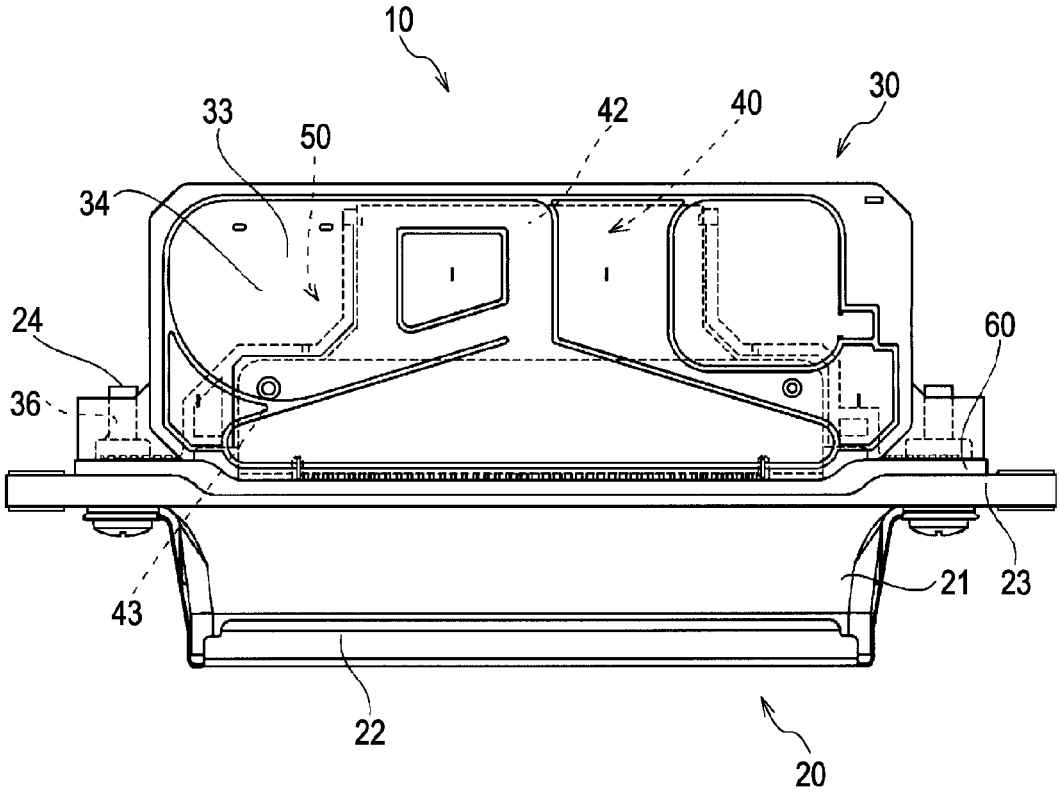
FIG. 3 is a front view of a head according to an embodiment of the invention.

The head 10 will now be described using FIGS. 2 and 3. The head 10 includes a main head body 20 and a self-sealing unit 30 in which a liquid introduction channel for introducing ink from the ink cartridge 2 (see FIG. 1) to the head 10 is formed.

The main head body 20 includes a head case 21, and a head cover 22 that protects the bottom end surface of the main head body 20 is provided in the head case 21. An opening (not shown) that exposes nozzle openings (described later) is formed in the head cover 22.

Figure 4:
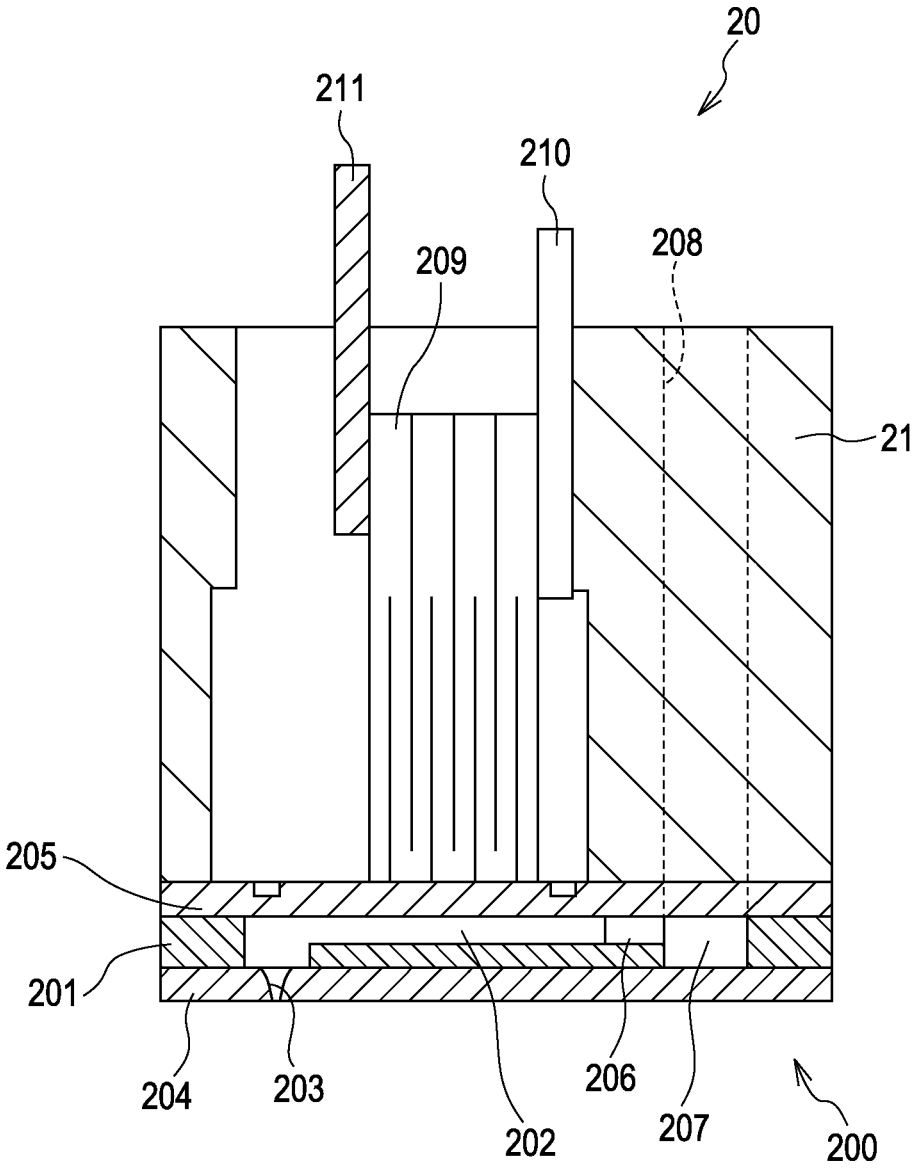
FIG. 4 is a cross-sectional view of a main head body according to an embodiment the invention.

The main head body 20 will now be described using FIG. 4. A flow channel formation portion 200 is provided in the bottom end of the head case 21 of the main head body 20. The flow channel formation portion 200 includes a flow channel plate 201. To illustrate further, multiple pressure generation chambers 202 are arranged in parallel in the flow channel plate 201; the surface on one side of the flow channel plate 201 is sealed by a nozzle plate 204 having nozzle openings 203 corresponding to respective pressure generation chambers 202, whereas the surface on the other side of the flow channel plate 201 is sealed by a vibration plate 205. The nozzle openings 203 are arranged in a row in the lengthwise direction in the bottom surface of the main head body 20. Furthermore, a manifold 207, serving as a common ink chamber for the multiple pressure generation chambers 202, is formed in the flow channel plate 201 so as to communicate with each of the pressure generation chambers 202 via an ink communication channel 206. A head case flow channel 208 provided in the head case 21 communicates with the manifold 207. Ink is supplied to the manifold 207 from the self-sealing unit 30 (see FIG. 2) via this head case flow channel 208. In this embodiment, a first liquid flow channel that includes the pressure generation chambers 202, the ink communication channel 206, the manifold 207, and the head case flow channel 208 is provided in the main head body 20.

Meanwhile, piezoelectric elements 209, serving as pressurizing units, are provided on the vibration plate 205 on the side opposite to the pressure generation chambers 202, with the ends of each piezoelectric element 209 making contact with a region corresponding to a respective pressure generation chamber 202. These piezoelectric elements 209 are configured by layering a piezoelectric material vertically between alternating layers of electrode-forming materials in a sandwich-like shape, and an inactive region that does not contribute to vibrations is anchored to an anchor plate 210.

Meanwhile, a wiring member 211 is connected to a respective piezoelectric element 209, and a driving signal is inputted into an electrode of the piezoelectric element 209 formed of the electrode-forming material from this wiring member 211.

With the ink jet recording head 10 configured in this manner, ink is supplied to the manifold 207 via the head case flow channel 208 that communicates with the self-sealing unit 30, thus distributing ink to the pressure generation chambers 202. To explain this in more detail, the piezoelectric element 209 constricts as a result of the application of the driving signal from the wiring member 211 thereto. As a result, the vibration plate 205 deforms along with the piezoelectric elements 209 (in FIG. 4, retracts in the upward direction), causing the capacity of the pressure generation chambers 202 to increase, thereby pulling ink into the pressure generation chambers 202. After ink has filled the chambers up to the nozzle openings 203, the voltage applied to the piezoelectric elements 209 is removed based on the driving signal, causing the piezoelectric elements 209 to extend and return to their original states. Through this, the vibration plate 205 is also displaced and returns to its original state, thereby causing the pressure generation chambers 202 to shrink, increasing the internal pressure thereof and discharging ink droplets from the nozzle openings 203 as a result. In other words, in this embodiment, longitudinally-vibrating piezoelectric elements 209 are provided as pressurizing units causing a change in the pressure of the pressure generation chambers 202.

Returning to FIGS. 2 and 3, a flange portion 23 is formed on the top surface side of the main head body 20, or in other words, on the side opposite to the bottom surface on which the head cover 22 that covers the nozzle plate is provided. The head 10 includes an FPC (Flexible Print Cable) 40 serving as a driving board upon this flange portion 23.

The FPC 40 is a film-form driving board that can be bent. In this embodiment, the FPC 40 is bent and held erect relative to the flange portion 23 by a holding member 50. The holding member 50 is provided upright on the flange portion 23 of the main head body 20.

The FPC 40 includes a connector 41 for connecting to an external wiring member (not shown) from a main printer unit. The FPC 40 also includes a board terminal portion (not shown) for sending signals to the aforementioned piezoelectric elements, and the wiring member 211 (see FIG. 4) connected to each piezoelectric element is electrically connected to this board terminal portion using solder or the like. In other words, the FPC 40 is configured to receive a driving signal from the main printer unit through a printer cable connected to the connector 41 and supply that driving signal to the piezoelectric element through the wiring member 211 connected to the board terminal portion.

The self-sealing unit 30 is provided on the top of the flange portion 23 of the main head body 20. The self-sealing unit 30 has a rectangular block shape having a rectangular panel; ink introduction holes 31 are provided at the ends of the upper portion thereof, and ink is supplied from the ink cartridge 2 (see FIG. 1) into the respective ink introduction holes 31. The ink supplied into one of the ink introduction holes 31 (on the left in FIG. 2) passes through a unit flow channel 32 (indicated by dotted lines in FIG. 2) provided within the self-sealing unit 30 and is sent to a main flow channel 33 provided in the panel surface of the self-sealing unit 30, whereas the ink supplied into the other of the ink introduction holes 31 (on the right in FIG. 2) passes through the unit flow channel 32 and is sent to a main flow channel 33 provided on the rear side of the paper as viewed from the perspective in FIG. 2. In other words, in the self-sealing unit 30 according to this embodiment, two unit flow channels 32 are provided in a symmetrical manner. Ink that has flowed through this main flow channel 33 is sent from the outer side of the panel surface to a lower portion on the inner side of the self-sealing unit 30, and is then sent to the head case flow channel 208 (see FIG. 4) from four discharge holes (not shown) to communication openings 61 of a sealing member 60. In this embodiment, a second liquid flow channel that includes the unit flow channels 32 and the main flow channels 33 is provided in the self-sealing unit 30.

Furthermore, valves (not shown) are provided in the unit flow channels 32 between the respective ink introduction holes 31 and entry portions 34 of the main flow channels 33, the valves operating so as to allow the flow of ink when the pressure in the manifold of the main head body 20 drops, or in other words, when ink is ejected and the pressure in the main flow channel 33 has become relatively lower. In the case where ink is being supplied from the ink introduction holes 31 at a predetermined pressure, or in other words, the case where ink has accumulated within the manifold of the main head body 20, the valve is put into a closed state, and when the pressure in the posterior side of the nozzle opening drops due to the ejection of ink, the valve is put into an open state due to the negative pressure generated thereby, and the ink is supplied to the main head body 20.

An FPC passage portion 35 is formed in the central area of the self-sealing unit 30. The FPC passage portion 35 is a cavity whose top and bottom are open, and is configured so as to house the FPC 40 held by the holding member 50. When the FPC 40 is housed in the FPC passage portion 35, the connectors 41 of the FPC 40 face the upper opening of the FPC passage portion 35.

In the case where the self-sealing unit 30 is to be installed in the main head body 20, positioning pins 24 provided in the main head body 20 are inserted into positioning holes 36 provided on the right and left areas of the self-sealing unit 30, thus performing the positioning. Note that the positioning pins 24 are bolts provided on the bottom surface of the flange portion 23 of the main head body 20, and the self-sealing unit 30 is anchored to and installed in the main head body 20 by inserting the positioning pins 24 into the positioning holes 36.

Furthermore, the head 10 includes the sealing member 60 between the main head body 20 and the self-sealing unit 30. In this embodiment, the self-sealing unit 30 corresponds to a head holder.

In the case where the self-sealing unit 30 is installed in the main head body 20, the sealing member 60 is installed between the main head body 20 and the self-sealing unit 30, and serves to ensure the seal between the openings of the head case flow channel 208 formed in the main head body 20 and the discharge holes within the self-sealing unit 30. In other words, a favorable seal is made by the sealing member 60 at the area where the openings of the head case flow channel 208 and the discharge holes within the self-sealing unit 30 are connected. The communication openings 61 that pass into and communicate with the openings of the head case flow channel 208 and the discharge holes within the self-sealing unit 30 are provided in the sealing member 60.

As described earlier, the sealing member 60 is inserted between the main head body 20 and the self-sealing unit 30, and thus a favorable seal is ensured by the sealing member 60 at the area where the first liquid flow channel and the second liquid flow channel are connected, or more specifically, between the openings of the head case flow channel 208 and the discharge holes of the self-sealing unit 30. More specifically, in this embodiment, the sealing member 60 is sandwiched between a protruding portion in which the discharge holes within the self-sealing unit 30 are provided and a protruding portion in which the head case flow channel 208 provided in the main head body 20 is provided, tightly sealing the area where the openings of the head case flow channel 208 and the discharge holes of the self-sealing unit 30 are connected and preventing ink from leaking from this connection area.

Figure 5:
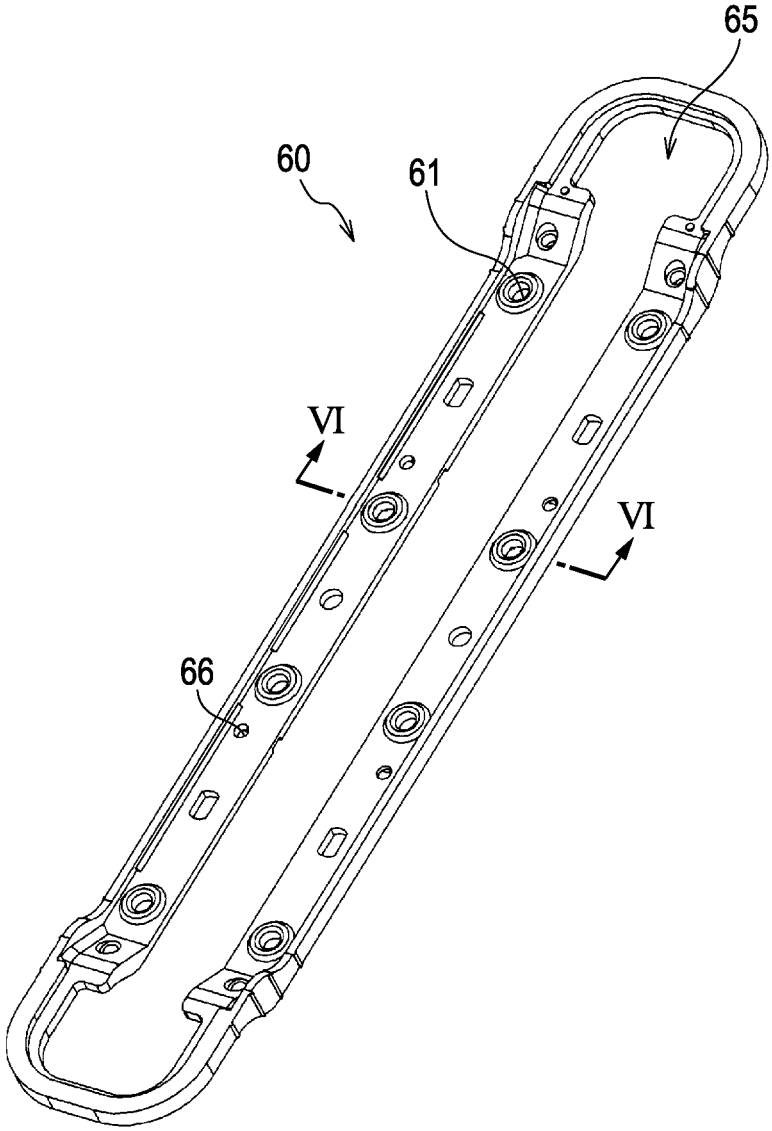
FIG. 5 is a perspective view illustrating a sealing member according to an embodiment of the invention.
Figure 6:
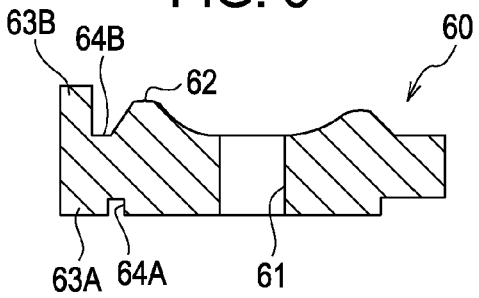
FIG. 6 is a cross-sectional view illustrating a sealing member according to an embodiment of the invention.
Figure 7:
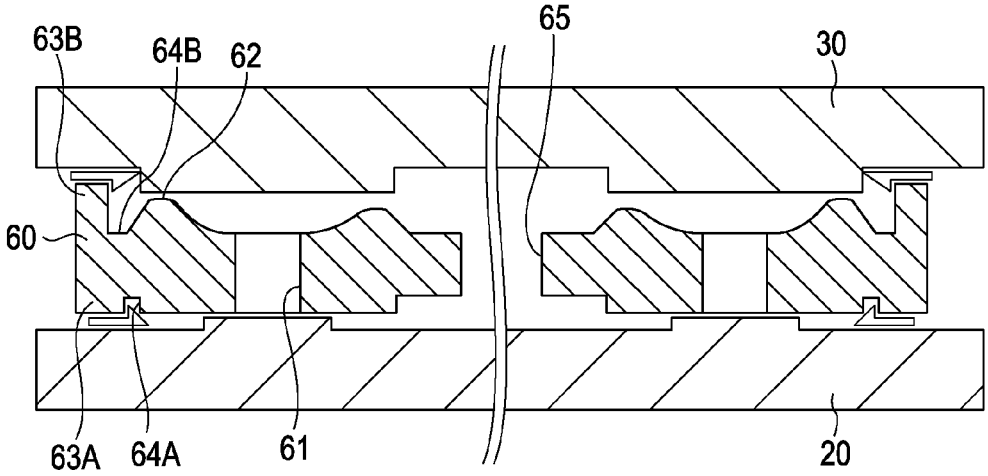
FIG. 7 is a descriptive diagram illustrating a sealing member according to an embodiment of the invention.

The sealing member 60 according to this embodiment will now be described using FIGS. 5 to 7. FIG. 5 is a perspective view of the sealing member; FIG. 6 is a cross-sectional view taken along the VI-VI line shown in FIG. 5; and FIG. 7 is a descriptive diagram illustrating the sealing member.

As shown in FIG. 5, the sealing member 60 is a plate-shaped member that has an opening 65 into which the main head body 20 is inserted. In this embodiment, the FPC 40 of the main head body 20 and the holding member 50 thereof are inserted into the opening 65 of the sealing member 60.

Meanwhile, the sealing member 60 is configured so as to match the shape of the flange portion 23 of the main head body 20, with the height of both ends in the lengthwise direction being higher than the height of the central portion in the lengthwise direction.

Four sets each of the communication openings 61 that pass through in the thickness direction are provided in the lengthwise direction of the sealing member 60, and are provided in locations corresponding to the openings of the head case flow channel 208 and the discharge holes of the self-sealing unit 30.

In addition, positioning holes 66 that pass through in the thickness direction are provided in the lengthwise direction of the sealing member 60. Positioning pins (not shown) provided in the main head body 20 can be inserted into these positioning holes 66. By inserting positioning pins into corresponding positioning holes 66, the communication openings 61 of the sealing member 60 seal the openings of the head case flow channel 208 and the discharge holes of the self-sealing unit 30.

Here, the circumferential edges of the communication openings 61 of the sealing member 60 will be described using FIG. 6.

As shown in FIG. 6, close-contact portions 62 are provided at the circumferential edges of the communication openings 61 of the sealing member 60. The close-contact portions 62 are compressed by pressure-contacting between the main head body 20 and the self-sealing unit 30, thus enabling the connection area between the first liquid flow channel and the second liquid flow channel to be tightly sealed.

In addition, a first contact portion 63A that protrudes toward the main head body 20 and makes contact with the main head body 20 and a second contact portion 63B that protrudes toward the self-sealing unit 30 and makes contact with the self-sealing unit 30 are provided in the sealing member 60 so as to correspond to the outer circumferential portion of the main head body 20. In this embodiment, the first contact portion 63A and the second contact portion 63B are provided in the sealing member 60 on the opposite side as the opening 65. Furthermore, in this embodiment, the contact portions are provided continuously around the external circumferential edge of the sealing member 60, as shown in FIG. 5. Thus in this embodiment, the first contact portion 63A and the second contact portion 63B are provided continuously around the external circumferential edge of the sealing member 60. The outer circumference can be sealed using the first contact portion 63A and the second contact portion 63B, thus making it possible to suppress liquid, air, and so on from infiltrating from the exterior.

Concave portions 64 (a concave portion 64A and a concave portion 64B) are provided in both surfaces of the sealing member 60, that is, where the protruding first contact portion 63A and second contact portion 63B are provided. In this manner, by forming the concave portions 64 on both sides of the sealing member 60 in the thickness direction, liquid can be suppressed from infiltrating from the exterior to the interior on both the top and bottom sides of the sealing member 60. The shape of the concave portions 64 is not particularly limited, and in this embodiment, the concave portion 64A and the concave portion 64B have different shapes, as shown in FIG. 6.

The sealing member 60 in the case where ink has infiltrated from the exterior will be described using FIG. 7.

As shown in FIG. 7, the sealing member 60 is configured so that even if ink infiltrates the main head body 20 from the exterior, or in other words, into the opening 65 of the sealing member 60, a meniscus is formed at the concave portions 64 (64A, 64B) due to the surface tension of the ink, and thus the ink does not flow into the interior. Through this, it is possible to prevent short-circuits caused by ink making contact with the wires in the FPC 40 of the main head body 20. A drop in the tightness of the seal of the close-contact portions 62 can also be suppressed. Note that although FIG. 7 illustrates a state in which the sealing member 60 is not pressurized (compressed) for the purposes of these descriptions, the sealing member 60 is in actuality pressurized by the main head body 20 and the self-sealing unit 30, and the close-contact portions 62 and contact portions 63 (the first contact portion 63A and the second contact portion 63B) are in a compressed state.

In addition, even if ink leaks to the exterior from the communication openings 61, or in other words, in the opposite direction as the opening 65 of the sealing member 60, the ink forms a meniscus at the concave portions 64 and thus the ink can be suppressed from leaking onto the contact members 63. A drop in the tightness of the seal around the outer circumference of the sealing member 60 can therefore be suppressed.

As described above, in this embodiment, the liquid flow channels are sealed by the close-contact portions 62 of the sealing member 60, and the ink can be suppressed from infiltrating the opening 65 of the sealing member 60 by the concave portions 64. In other words, the infiltration of liquid can be suppressed using only the sealing member, and thus damage caused by the infiltration of liquid can be suppressed. Accordingly, it is not necessary to mold the sealing member 60 using an adhesive, making it possible to reduce the number of manufacturing steps and materials costs, which in turn makes it possible to reduce overall costs. Furthermore, because an adhesive is not used, it is easy to break the head down if a problem such as a malfunction is found in the main head body 20 or the self-sealing unit 30, thus making it possible to reuse the head.

Furthermore, by providing the first contact portion 63A and the second contact portion 63B continuously in the external circumferential edge, the external edge can be sealed, which makes it possible to favorably suppress the infiltration of liquid from the exterior and the inflow of air from the exterior. Accordingly, the infiltration of ink into the opening 65 of the sealing member 60 can be more effectively suppressed.

Other Embodiments

Although an embodiment of the invention has been described in detail thus far, the invention is of course not limited to the aforementioned embodiment. For example, although the above embodiment describes an example in which a plate-shaped member having the opening 65 into which the main head body 20 is inserted is used as the sealing member 60, the sealing member 60 according to another embodiment may have a shape created by combining multiple sealing members.

Figure 8:
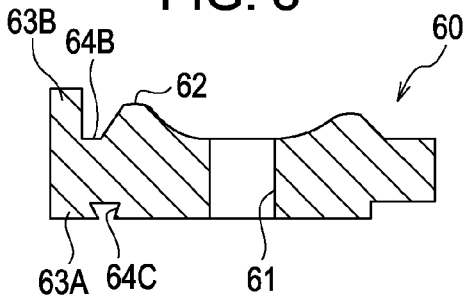
FIG. 8 is a descriptive diagram illustrating a sealing member according to another embodiment of the invention.

Furthermore, the shapes of the concave portions 64 in the sealing member 60 are not limited to those described above, and may include, for example, a tapered portion, such as that of a concave portion 64C illustrated in FIG. 8.

Although the first contact portion 63A and the second contact portion 63B are provided on the opposite side of the opening 65 in the sealing member 60 in the aforementioned embodiment, contact portions may also be provided on the side of the opening 65 in the sealing member 60.

Furthermore, although the self-sealing unit 30 is illustrated as an example in the aforementioned embodiment, the unit flow channel or the like is not limited. For example, although the aforementioned embodiment illustrates an example of a self-sealing unit in which a valve is provided, the self-sealing unit may be a unit that includes a liquid flow channel in which a valve is not provided.

Although the aforementioned embodiment described a configuration in which a sealing member is disposed between a self-sealing unit, which is an example of a head holder, and a main head body, this is nothing more than an example; the invention can be applied regardless of the location of the sealing member as long as the configuration is such that the sealing member is disposed between an ink cartridge and a main head body. In other words, the technique described in this invention can be applied regardless of which area between the ink cartridge and the main head body the sealing member is disposed.

Furthermore, although the aforementioned embodiment describes an ink jet recording head as an example of a liquid ejecting head, the invention is targeted at liquid ejecting heads in general, and thus can of course be applied in liquid ejecting heads that eject liquids aside from ink. Various types of recording heads used in image recording apparatuses such as printers, coloring material ejecting heads used in the manufacture of color filters for liquid-crystal displays and the like, electrode material ejecting heads used in the formation of electrodes for organic EL displays, FEDs (field emission displays), and so on, bioorganic matter ejecting heads used in the manufacture of biochips, and so on can be given as other examples of liquid ejecting heads.

What is claimed is:

1. A liquid ejecting head comprising:

a main liquid ejecting head body, in which is formed a first liquid flow channel through which a liquid flows, that is configured so as to eject the liquid from a nozzle opening using a pressurizing unit;

a head holder including a second liquid flow channel, one end of the second liquid flow channel communicating with a holding member that holds the liquid and the other end of the second liquid flow channel communicating with the first liquid flow channel; and a sealing member, disposed between the main liquid ejecting head body and the head holder, that includes a communication opening that allows the first liquid flow channel to communicate with the second liquid flow channel, wherein the sealing member further includes:

a close-contact portion provided in the circumferential edge of the communication opening;

a first contact portion that protrudes toward the main liquid ejecting head body and makes contact with the main liquid ejecting head body; and a second contact portion that protrudes toward the head holder and makes contact with the head holder;

wherein the sealing member is pressed by the main liquid ejecting head body and the head holder to compress the first contact portion and the second contact portion.

2. The liquid ejecting head according to claim 1, wherein the sealing member includes a plurality of the communication openings.

3. The liquid ejecting head according to claim 1, wherein the sealing member is disposed between a first protruding portion in which the other end of the second liquid flow channel is disposed and a second protruding portion in which an opening of the first liquid flow channel is disposed.

4. The liquid ejecting head according to claim 1, wherein the sealing member includes a plurality of communication openings, and wherein the first contact portion or the second contact portion or both is formed on a circumferential portion of the sealing member and surrounds the plurality of communication openings.

5. The liquid ejecting head according to claim 1, wherein the first contact portion and the second contact portion are at least partially aligned in a thickness direction of the sealing member.

6. A liquid ejecting apparatus comprising the liquid ejecting head according to claim 1.

7. A liquid ejecting head comprising:

a main liquid ejecting head body, in which is formed a first liquid flow channel through which a liquid flows, that is configured so as to eject the liquid from a nozzle opening using a pressurizing unit;

a head holder including a second liquid flow channel, one end of the second liquid flow channel communicating with a holding member that holds the liquid and the other end of the second liquid flow channel communicating with the first liquid flow channel; and a sealing member, disposed between the main liquid ejecting head body and the head holder, that includes a communication opening that allows the first liquid flow channel to communicate with the second liquid flow channel, wherein the sealing member further includes:

a close-contact portion provided in the circumferential edge of the communication opening;

a first contact portion, provided in correspondence with the outer circumferential portion of the main liquid ejecting head body, that protrudes toward the main liquid ejecting head body and makes contact with the main liquid ejecting head body; and a second contact portion that protrudes toward the head holder and makes contact with the head holder; and wherein the sealing member is a plate-shaped member having an opening into which a wire that connects to the main liquid ejecting head body is inserted; and the first contact portion and the second contact portion are each provided in a continuous manner at the external circumferential edge.

8. The liquid ejecting head according to claim 7, wherein the height of the sealing member at both ends in the lengthwise direction of the sealing member is higher than the height of the central portion of the sealing member in the lengthwise direction of the sealing member.

9. A liquid ejecting apparatus comprising the liquid ejecting head according to claim 7.

* * * * *